United States Patent [19]

Knight

[11] Patent Number: 5,015,532

[45] Date of Patent: May 14, 1991

[54] TAXIDERMY TROPHY AND PROCESS

[76] Inventor: Thomas E. Knight, P.O. Box 129, Ivor, Va. 23866

[21] Appl. No.: 526,233

[22] Filed: May 21, 1990

[51] Int. Cl.[5] ..... B44C 5/02; G09F 19/00

[52] U.S. Cl. ..... 428/542.4; 428/16; 428/913.3; 434/296

[58] Field of Search ..... 428/542.4, 913.3, 16; 434/296

[56] References Cited

U.S. PATENT DOCUMENTS

| | | | |
|---|---|---|---|
| 453,008 | 5/1891 | Kaempfer | 428/542.4 X |
| 2,003,896 | 6/1935 | Menger | 434/296 |
| 2,354,622 | 7/1944 | Swartz | 428/913.3 X |
| 3,319,922 | 5/1967 | Christensen | 428/913.3 X |
| 4,464,440 | 8/1984 | Dotzman | 428/542.4 |
| 4,477,500 | 10/1984 | Powell | 428/542.4 X |
| 4,717,626 | 1/1988 | Badger | 428/542.4 |

*Primary Examiner*—Henry F. Epstein

*Attorney, Agent, or Firm*—Wallace J. Nelson

[57] ABSTRACT

A molded plastics taxidermy manikin receives an animal head skin stretched over and glued thereto with the aft open end of the head skin overlapping a peripheral extension of the manikin and being stapled to a wooden recessed insert provided therein. A center vertical groove is provided on the recessed insert and an elongated protuberance attached to the face of a mounting decorative wall plaque matingly engages the vertical groove. The protuberance-groove mating surfaces prevent relative horizontal and rotative movement between the plaque and the skin coated manikin while permitting relative vertical movement therebetween resulting in easy centering of the skin coated manikin on the plaque. A plurality of wood screws are positioned through predrilled holes in the plaque to engage the recessed wooden insert and attach the plaque to the skin coated manikin while the parts are maintained in relative centered position.

10 Claims, 3 Drawing Sheets

TAXIDERMY TROPHY AND PROCESS

FIELD OF THE INVENTION

This invention relates to taxidermy models, in general, and relates specifically to a mounting apparatus and process for mounting animal head skins on to a manikin and securing the mounted skin to a decorative wall plaque.

BACKGROUND OF THE INVENTION

Part of the thrill or reward of the game animal hunt resides in obtaining a decorative trophy for display in the home or office. Also, there is considerable competition among hunters and taxidermists in obtaining the most attractive trophy. Numerous sportsmen are attracted to competitive shows wherein game animal trophies are displayed and judged. Some of the criteria used in judging of the trophies include the centering of the mounted trophy on the decorative wall plaque, the secure or tight attachment of the plaque to the mounted animal head skin, and the neatness in the plaque and mounted skin connection plane.

In mounting animal heads a suitable manikin or model of the animal head to be mounted is produced and the animal head skin stretched over and secured to the manikin prior to attachment of a decorative wooden wall plaque thereto. The attachment of the mounted animal head skin to a plaque normally requires at least two people and frequently results in portions of the skin overflowing the manikin and results in an unsightly appearance at the contact surfaces between the skin coated manikin and the plaque. Also, it is difficult to achieve a tight attachment of the skin coated manikin to the plaque due to excess skin at the manikin base. Further, it is difficult to position and secure the manikin coated skin at the center of the plaque. The present invention alleviates some or all of these deficiencies in the prior art systems.

Accordingly, it is an object of the present invention to provide an improved apparatus and process for taxidermists in preparing animal head trophies.

Another object of the present invention is to provide an improved apparatus for mounting animal head skins onto a manikin that results in a tight, centered connection between the skin coated manikin and a decorative wall plaque.

Another object of the present invention is an improved process for attaching an animal head skin coated manikin to a decorative wall plaque.

A further object of the present invention is an apparatus for attaching an animal head skin to a manikin that aligns and permits easy centering attachment of the manikin to a decorative wall plaque.

SUMMARY OF THE INVENTION

According to the present invention, the foregoing and additional objects are attained by providing a molded plastics taxidermy manikin having the size and shape to receive a selected animal head skin and having a front, or nose end, and an aft end. A recessed wooden insert spans and is disposed adjacent the aft end of the manikin such that a peripheral portion of the molded manikin extends aft, and terminates on a plane horizontal to, the wooden insert. An elongated vertical groove is provided in the exposed planar face of the wooden insert and extends substantially along the center thereof.

The molded manikin is attached via wood screws, or the like, to a mounting stand and coated with a suitable room temperature curing adhesive. When the adhesive cures to a tacky state, the prepared animal head skin is stretched over the adhesively coated manikin with the excess portions of the skin being pulled or overlapped about the peripheral aft end portion of the manikin. This overlapped skin is stapled or otherwise conventionally attached to the recessed wooden insert. The assembly is then permitted to air dry at room temperature to permit final cure of the adhesive and evaporation of any accumulated moisture in the skin and manikin structure. After drying, any excess skin on the overlapping portions is removed by trimming, the animal head skin is brushed, and finishing touches are performed on the nose, eyes, ears and mouth portions prior to removal of the skin covered manikin from the mounting stand.

A decorative wall plaque is selected to receive the mounted animal skin head with at least two, and preferably four, predrilled spaced holes provided through the plaque. An elongated protuberance, having an essentially T-shaped cross-sectional area, is secured along, and at the substantial center of, a vertical center line of the plaque. The horizontal cross bar of the "T" configured protuberance is attached to the plaque with the vertical leg of the "T" extending therefrom. The extending portion is configured to be received by and mate with the elongated vertical groove formed in the wooden insert of the manikin. This mating engagement of the protuberance and groove prevents relative horizontal and rotative movement between the skin coated manikin and the plaque while permitting relative vertical movement therebetween. This relative vertical movement permits centering of the aft end of the skin coated manikin on the plaque and, while retained in this centered position, two-four wood screws are inserted through the predrilled holes in the plaque to engage and tightly secure the wooden insert in the manikin to the plaque.

BRIEF DESCRIPTION OF THE DRAWINGS

A more complete appreciation of the invention and many of the attendant advantages thereof will be more readily apparent as the same becomes better understood in reference to the following detailed description when considered in connection with the accompanying drawings wherein.

DETAILED DESCRIPTION

Figure 1:
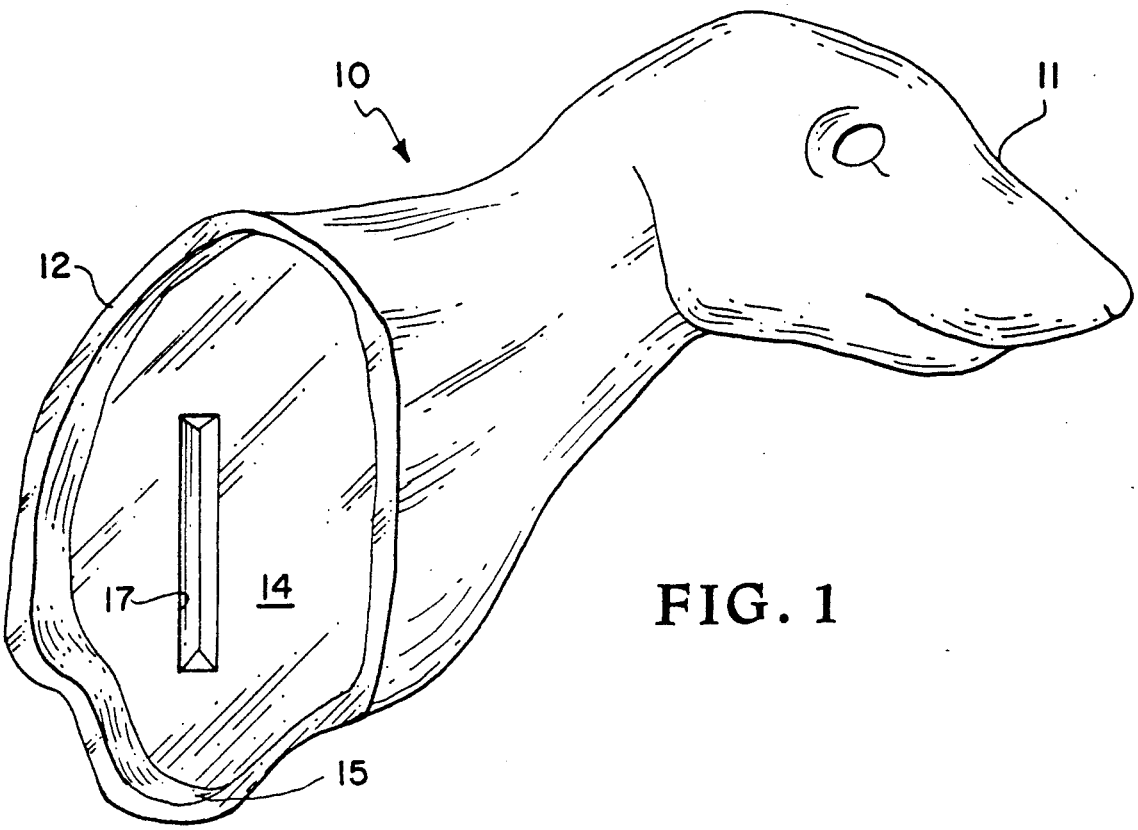
FIG. 1 is a rear perspective view of an exemplary molded plastics manikin employed in the present invention.

Referring now to the drawings, and more particularly to FIG. 1, an animal head manikin employed in practice of the present invention is shown and designated generally by reference numeral 10. Manikin 10 has a head or nose end 11 and an aft or base end 12. A recessed wooden insert 14 is molded within the aft end 12 of manikin 10. The apparatus and process for forming molded polyurethane or other plastics manikins suitable for practice of the present invention are described in copending patent application Ser. No. 459,687 filed Jan. 2, 1990 and incorporated herein by reference. The end peripheral portion 15 of manikin 10 extends aft of the wooden insert 14. An elongated vertically disposed groove 17 is provided extending substantially along the center of insert 14.

Figure 2:
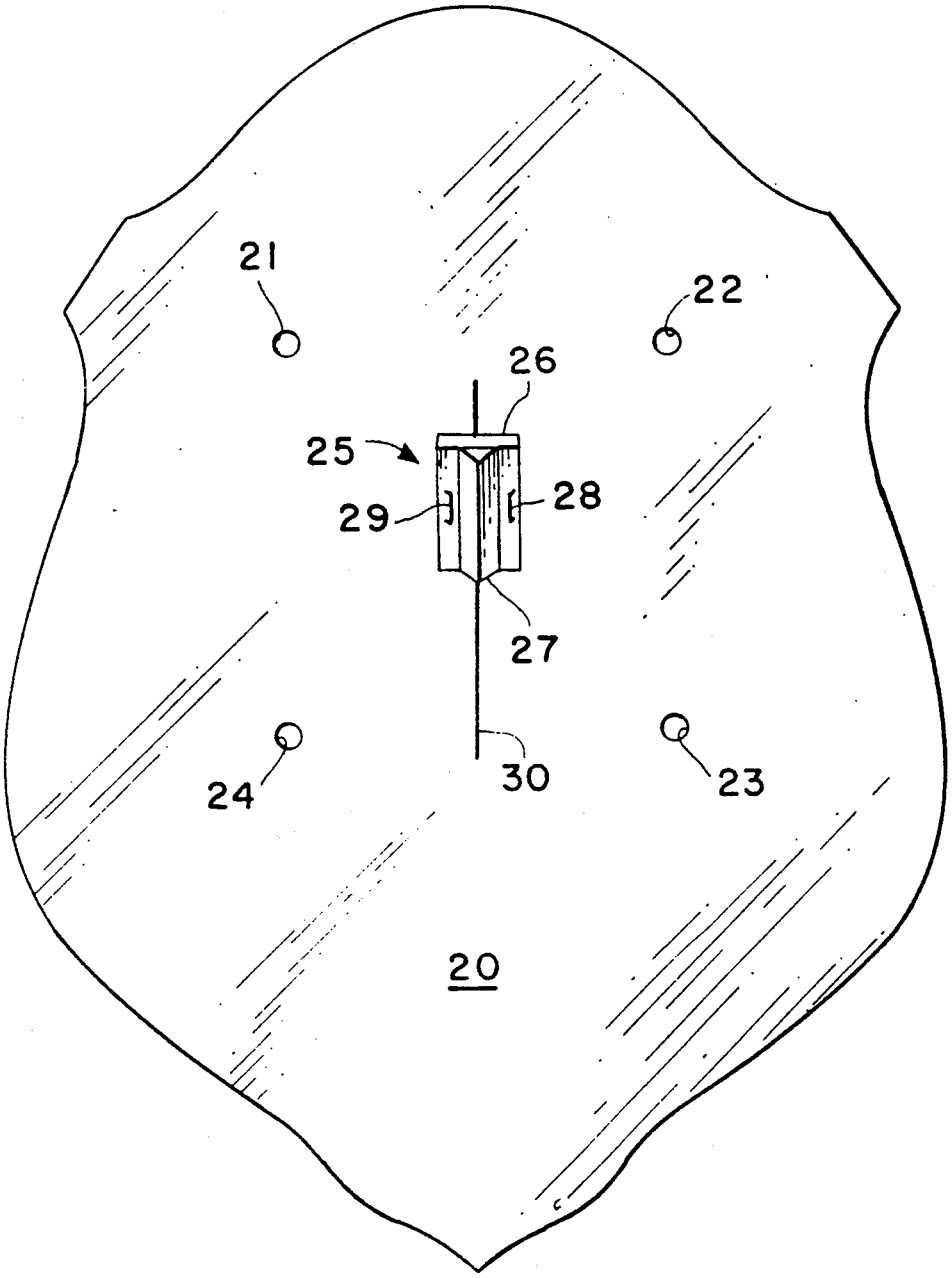
FIG. 2 is a front view of a decorative wall plaque according to the present invention and having an aligning protuberance attached thereto.

Referring now more particularly to FIG. 2, an exemplary wooden decorative wall plaque 20 is illustrated. As shown therein, wall plaque 20 is provided with at least four spaced through holes, designated by reference numerals 21, 22, 23 and 24, as will be further explained hereinafter. An elongated protuberance 25 is attached to wooden plaque 20 via a pair of staples 28, 29. Protuberance 25 is aligned with a vertical mark 30 drawn by a suitable marker on plaque 20. The location of vertical mark 30 is determined by establishing the top and bottom center point on the face of plaque 20, positioning a straight edge aligning these points, and drawing a line or mark 30 several inches long along the center area of plaque 20 between the top and bottom center points. Proturberance 25 is then centered on mark 30 and stapled to plaque 20 via staples 28, 29.

Figure 3:
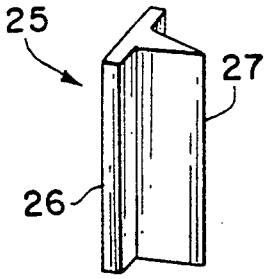
FIG. 3 is another view of the aligning elongated protuberance shown in FIG. 2 and prior to attachment to the wall plaque.

As shown more particularly in FIG. 3, protuberance 25 has an essentially T-shaped cross sectional area with the horizontal end or top 26 thereof being abutted against plaque 20 and receiving staples 28, 29 therethrough. The vertical leg of T-shaped protuberance 25, designated by reference numeral 27, has an exposed section area that mates with the internal surface of groove 17 formed in wooden insert 14. In the illustrated embodiment, vertical leg 27 of protuberance 25 is essentially wedge shaped and tapers, from horizontal top 26 to a point, to mate with the elongated tapered or wedge shaped recess of groove 17, as will be further explained hereinafter.

Figure 4:
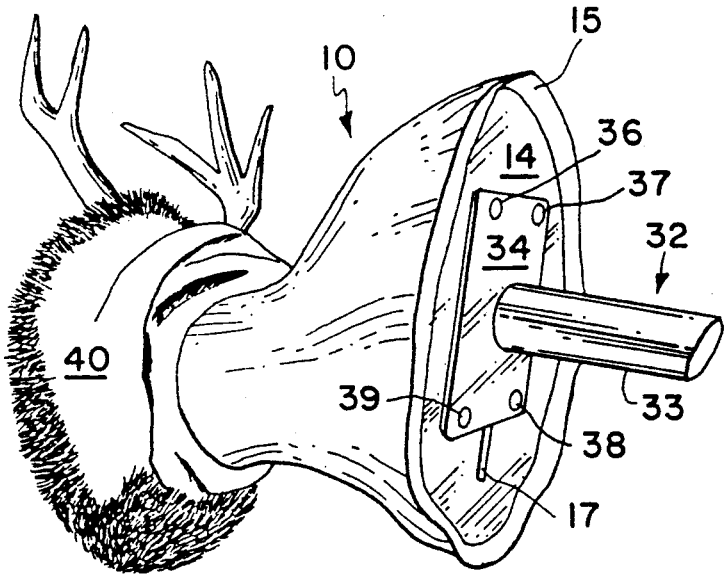
FIG. 4 is a view of the manikin shown in FIG. 1, coated with an adhesive, and attached to a mounting stand with an animal head skin partially received thereon.

Referring now more particularly to FIG. 4, manikin 10 is shown attached to a mounting stand 32. Mounting stand 32 includes a substantially horizontal shaft 33 secured to suitable structure at one end (not illustrated) and provided with a mounting plate 34 welded, or otherwise conventionally attached, to the other end thereof. A plurality of wood screws, four in the illustrated embodiment and designated by reference numerals 36, 37, 38 and 39, extend through suitable openings in mounting plate 34 to engage insert 14 and releasably attach manikin 14 to mounting stand 32.

Once mounted, the entire surface of manikin 10 is coated with a suitable adhesive or glue such, for example, Dextrine Based, Hide Paste from Taxidermy Suppliers or Bulldog Linoleum Paste, a product of the W. W. Henry Company, Huntington Park, Calif. 90255. Immediately after application of the adhesive the animal head skin 40 is placed over manikin 10 and stretched into tight engagement over the entire length thereof.

Figure 5:
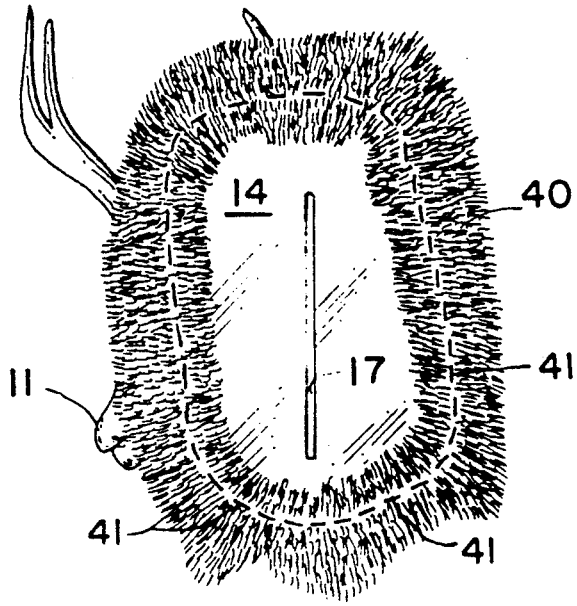
FIG. 5 is a view of the skin coated manikin shown in FIG. 4 when removed from the mounting stand and illustrating the attachment of the aft overlapping skin portions.

As shown more particularly in FIG. 5, the aft end of skin 40 laps over peripheral portion 15 of manikin 10 and the overlapped end thereof is stapled, via a plurality of staples 41 to insert 14. The mounted skin 40 is permitted to air dry at room temperature for twelve to twenty-four hours to permit final cure or setting of the adhesive and to permit evaporation of any moisture in the skin and manikin structure. Finishing touches are then made to the animal skin in the eye, ear, nose and mouth regions prior to separation of the structure from mounting stand 32. Any excess skin at the overlapping area at the base of the mounted head skin is removed by trimming prior to removal of the mounting stand 32.

Figure 6:
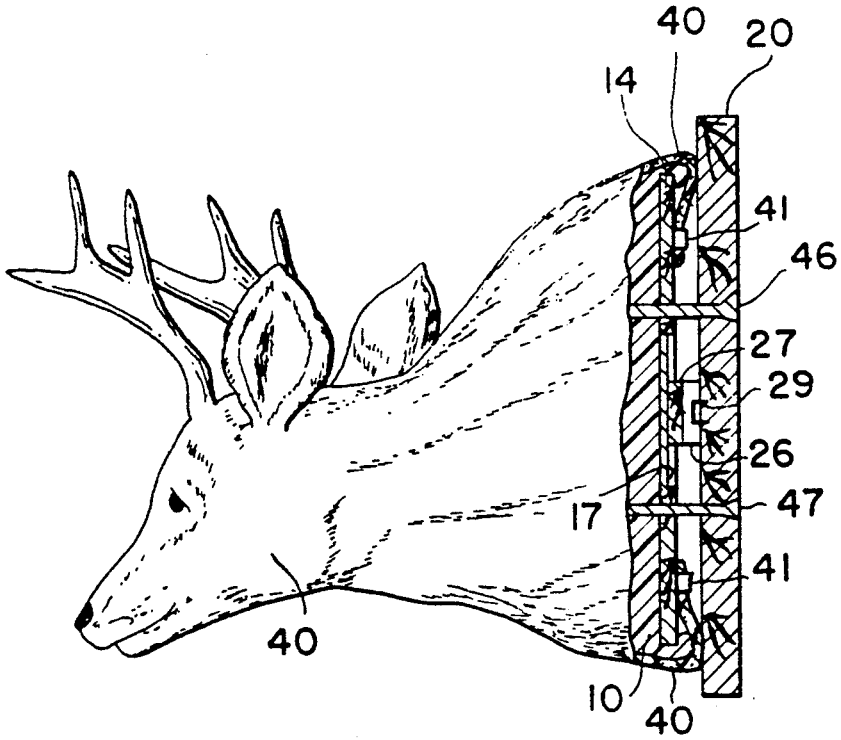
FIG. 6 is a view of the animal head skin and manikin shown in FIG. 2 attached to a decorative wall plaque according to the present invention.

Referring now more particularly to FIGS. 2 and 6, a suitable decorative wall plaque 20 is selected for the mounted skin. The top and bottom center points on plaque 20 are determined and, by employing a straight edge extending between these points, a mark 30 is made on plaque 20 by use of a pencil or other suitable marking tool. Mark 30 is located at substantially the center, of and has a length approximately one-third of, the distance between the top and bottom center points of plaque 20. For mounting deer heads, as in the illustrated embodiment, plaque 20 normally measures at least eighteen inches between the top and bottom center points and mark 30, in this instance, would be approximately six inches in length. Elongated protuberance 25 is visually aligned at substantially the center of mark 30, and fastened to plaque 20 by employing at least a pair of staples 28, 29 extending through opposite sides of the horizontal portion 26 of the T-shaped cross-sectional area.

In the illustrated embodiment, T-shaped protuberance 25 has a length of approximately two inches, the width of the horizontal portion 26 is approximately one and one half inches, the attached end of vertical leg 27 has a width of one-half inch and tapers over a length of one and one-half inches to a point. Groove 17 is of a female wedge configuration and matingly receives the tapered point portion of leg 27. Recessed insert 14 has a thickness of approximately one inch and the depth of groove 17 therein is at least one half inch. The peripheral extension portion of manikin 10 that extends aft of recessed insert 14 has a length or depth of approximately one inch.

For assembly, mounted skin 40 is positioned over plaque 20 with vertical leg 27 of elongated protuberance 25 being received by groove 17 in insert 14. The premeasured positioning of groove 17 and protuberance 25 ensures horizontal centering of mounted skin 40 onto plaque 20. The mating engagement of protuberance 25 within groove 17 prevents relative horizontal and rotative movement between mandrel 10 and plaque 20. Relative vertical movement is permitted between these parts since leg 17 on protuberance 25 is freely slidable within mating groove 17. The mounted skin 40 on manikin 10 is visually centered on plaque 20 by relative vertical movement of the parts and, while held in this position, suitable wood screws 46, 47 and others, not shown, are inserted through predrilled holes 21, 22, 23 and 24 of plaque 20 to engage and attach wooden insert 14 thereto. Tightening of screws 46, 47 and the others, not shown, results in a flush, tight fit of mounted skin 40 and manikin 10, at a centered position, to plaque 20. The mounting process described may be performed by one individual and results in a final mounted trophy that has improved durability, a tighter and more accurately centered position and an improved appearance over that produced by prior art processes.

Although the invention has been described relative to specific materials and dimensions, it is not so limited and there are many variations and modifications thereof that will be readily apparent to those skilled in the art.

For example, manikin 10 may be formed of any suitable molded plastics material, and recessed insert 14, disposed therein, may be formed of other materials than the wood described in the preferred embodiment herein. Also, the mating surfaces of groove 17 and protuberance leg 27 received therein may be of other configurations than the tapered wedge configuration described herein, as long as relative vertical movement between the parts is permitted, while preventing relative horizontal and rotative movement therebetween. The staples described herein may be replaced or supplemented with suitable upholstery nails, carpet tacks, or the like, without departing from the spirit or scope of the present invention. In the preferred embodiment, decorative wall plaque 20 is formed of a quality wood, such for example walnut, but could be formed of a suitable finished metal, composite or cheaper wood having a veneer or other expensive appearing wood finish, if so desired. These and other modifications in the present invention will be readily apparent to those skilled in the art in the light of the above teachings.

It is therefore to be understood that, within the scope of the appended claims, the invention may be practice other than as specificaly described herein.

What is claimed as new and desired to be secured by Letters Patent of the United States is:

1. Means facilitating mounted alignment and flush fit of a taxidermy model to substantially the center of a decorative wall plaque comprising, in combination:

a manikin having the size and shape to receive an animal head skin and adapted to be mounted on a decorative wall plaque;

said manikin having a front and an aft end and formed of a molded plastics;

a recessed wooden insert fixedly provided in the aft end of said manikin such that peripheral portions of said manikin extend aft of said wooden insert;

an elongated, vertically disposed, groove extending substantially along the center of said wooden insert;

a decorative wall plaque;

a protuberance connected substantially at the center of said wall plaque and disposed in vertical relationship therewith;

said protuberance being slidably received within the elongated vertically disposed groove on said insert;

said protuberance and said groove serving to permit relative vertical movement while preventing relative horizontal and rotative movement between said manikin and said plaque; and attachment means for tightly securing said manikin to said plaque.

2. The means of claim 1 including said protuberance having a substantially T-shaped cross-sectional area and wherein the horizontal top of said T-shaped protuberance is connected to said wall plaque and the vertical leg of said T-shaped protuberance mates with and is slidably disposed within said elongated groove in said wooden insert.

3. The means of claim 2 wherein at least a pair of staples are employed to connect said T-shaped protuberance to said wall plaque.

4. The means of claim 1 including an animal skin head stretched over and glued to said manikin prior to positioning said plaque protuberance into said groove of said wooden insert, said animal skin head having portions thereof overlapping the peripheral portions at said aft end of said manikin and means fixedly securing the overlapping portions of said animal skin head to said wooden insert.

5. The means of claim 4 wherein said manikin receiving said animal skin head is vertically centered on said plaque prior to securing said manikin to said plaque and said attachment means for securing said manikin to said plaque includes at least two screws extending through said plaque into said wooden insert of said manikin.

6. The means of claim 1 including an animal head skin covering said manikin with the aft end of the skin being strectched to overlap the aft end of said manikin, said animal head skin being glued to the major portions of said manikin and including additional means attaching the skin aft end that overlaps the aft end of said manikin to said wooden insert.

7. The means of claim 1 including an animal head skin stretched over and secured to said manikin and wherein the skin coated manikin is positioned on and vertically centered on said plaque by relative vertical movement of said manikin and plaque while retaining the horizontal relationship therebetween due to the protuberance on said plaque being received by said groove in said wooden insert.

8. A method of preparing, aligning and tightly securing a taxidermy specimen to a decorative wall plaque, comprising the steps of:

providing a molded plastics taxidermy manikin having the size and shape to receive a selected animal head skin and having a front and an aft end;

providing a recessed wooden insert within the aft end of the manikin such that a peripheral portion of the molded manikin extends aft of the wooden insert;

providing an elongated vertical groove extending substantially along the center of the wooden insert;

securing the molded plastics taxidermy manikin to a mounting stand;

applying a coating of glue to the exterior surfaces of the molded plastics taxidermy manikin;

stretching and attaching the selected animal head skin to the glue coated manikin such that portions of the skin overlap the peripheral portion of the molded manikin at the aft end thereof;

attaching the overlapping portions of the skin to the recessed wooded insert;

permitting the attached skin and manikin to air dry at room temperature to permit setting of the glue and evaporation of moisture in the skin and manikin structure;

brushing the animal head skin and providing finishing touches on the nose, eyes, ears and mouth sections of the animal head;

trimming excess skin from the overlapped portions attached to the recessed wooden insert;

providing a decorative wall plaque having at least two predrilled spaced holes therethrough to receive the taxidermy specimen;

attaching an elongated protuberance, having a protruding portion that mates with the internal configuration of the elongated groove in the wooden insert, at substantially the vertical center of the decorative wall plaque;

removing the animal head skin coated manikin from the mounting stand;

positioning the mating portion of the elongated protuberance attached to the plaque within the elongated groove of the wooden insert to horizontally center the relative position of the taxidermy model on the plaque;

vertically moving the taxidermy model relative to the plaque to slidably move the protuberance on the plaque within the groove of the wooden insert and vertically center the taxidermy model on the plaque; and while maintaining the taxidermy model centered on the plaque, inserting at least a pair of screws through the plaque into the wooden insert of the taxidermy model to tightly secure the model to the plaque.

9. The method of claim 8 wherein the elongated protuberance has a substantially T-shaped cross sectional area and the step of attaching the elongated protuberance to the plaque includes stapling the horizontal portion of the T-shaped cross sectional area to the plaque and the vertical leg of the T-shaped cross sectional area protuberance is received by the groove in the wooden insert.

10. The method of claim 8 wherein the step of attaching the overlapping portions of the animal head skin to the wooden insert includes stapling the overlapping animal head skin portions to the wooden insert.

* * * * *